US008502179B1

(12) United States Patent
Zolli

(10) Patent No.: US 8,502,179 B1
(45) Date of Patent: Aug. 6, 2013

(54) AMALGAM OF CRUSHED HAZARDOUS RADIOACTIVE WASTE, SUCH AS SPENT NUCLEAR FUEL RODS, MIXED WITH COPIOUS AMOUNTS OF LEAD PELLETS, ALSO GRANULATED, TO FORM A MIXTURE IN WHICH LEAD GRANULES OVERWHELM

(76) Inventor: Christine Lydie Zolli, Oldwick, NJ (US)

( * ) Notice: Subject to any disclaimer, the term of this patent is extended or adjusted under 35 U.S.C. 154(b) by 175 days.

(21) Appl. No.: 13/173,205

(22) Filed: Jun. 30, 2011

(51) Int. Cl.
*G21F 3/00* (2006.01)
*G21F 1/12* (2006.01)

(52) U.S. Cl.
USPC ..... 250/517.1; 250/515.1; 250/505.1

(58) Field of Classification Search
USPC ..... 250/505.1, 506.1, 515.1, 516.1, 517.1, 250/518.1, 519.1
See application file for complete search history.

(56) References Cited

U.S. PATENT DOCUMENTS

| | | | | |
|---|---|---|---|---|
| 3,696,636 | A | 10/1972 | Mille | |
| 4,102,512 | A | 7/1978 | Lewallyn | |
| 4,338,215 | A * | 7/1982 | Shaffer et al. | 588/15 |
| 5,278,879 | A | 1/1994 | McDaniels, Jr. | |
| 5,711,016 | A * | 1/1998 | Carpena et al. | 588/10 |
| 2002/0122525 | A1 | 9/2002 | Rosenberger | |
| 2006/0233685 | A1 * | 10/2006 | Janes | 423/3 |
| 2009/0205363 | A1 * | 8/2009 | de Strulle | 62/533 |

* cited by examiner

*Primary Examiner* — Robert Kim
(74) *Attorney, Agent, or Firm* — Hess Patent Law Firm LLC; Robert J. Hess

(57) ABSTRACT

A method, a product and an apparatus suited to transform radioactive waste by forming an amalgam of crushed hazardous radioactive waste, such as spent nuclear fuel rods, mixed with copious amounts of lead pellets, also granulated, to form a mixture in which lead granules overwhelm, and which is then further enclosed between solid lead slabs and compressed between rollers under high pressure to render the rolled end product a compacted amalgam radiation-free for integration into the environment.

32 Claims, 4 Drawing Sheets

AMALGAM OF CRUSHED HAZARDOUS RADIOACTIVE WASTE, SUCH AS SPENT NUCLEAR FUEL RODS, MIXED WITH COPIOUS AMOUNTS OF LEAD PELLETS, ALSO GRANULATED, TO FORM A MIXTURE IN WHICH LEAD GRANULES OVERWHELM

FIELD OF THE INVENTION

The present invention relates to an amalgam of crushed radioactive waste materials, such as crushed spent fuel rods and other radioactive byproducts from nuclear reactors, and copious amounts of fine pellets of lead that together form a mixture in the amalgam. The mixture is compressed under heavy pressure and then compacted and rolled between sheets of lead slabe that serve as a barrier against radiation penetration. The end product may be safely integrated into the environment for storage since the radiation is in effect neutralized from the amalgam. If the spent fuel rods are too hot due to their radioactivity, then they may cooled rapidly with a cryogenic fluid and, before they can become hot again, the spent fuel rods are crushed into smaller pieces and dispersed to mix with the copious amounts of fine pellets of lead to form the mixture in the amalgam.

BACKGROUND OF THE INVENTION

Molecules of lead trap uranium radiation, essentially blocking radiation from appreciably penetrating the lead. That lead traps radioactivity is well known conventionally. U.S. federal safety standards set forth regulations governing nuclear medicine and radiology departments of hospitals. For instance, the transport of nuclear medicine to and from a radiology department at a hospital may be in a lead pig whose dimension and construction must meet federal safety requirements to prevent unacceptable levels of radiation exposure to handlers of the lead pig. Personnel in radiology departments wear lead aprons to protect themselves from excessive exposure to radiation in their working environment. Lead walls are provided to isolate cobalt cancer treatment machines and diagnostic X-ray machines. Therefore, lead has proven to be an effective barrier against radiation exposure to prevent the penetration of the radiation through the lead.

According to the International Atomic Energy Agency (IAEA):

Radioactive sources are used throughout the world for a wide variety of peaceful and productive purposes in industry, medicine, research and education, and in military applications. These sources utilize radioactive materials that are firmly contained or bound within a suitable capsule or housing; although some sources involve radioactive materials in an unsealed form.

Until the 1950s, only radionuclides of natural origin, particularly radium-226, were generally available for sources. Since then, radionuclides produced artificially in nuclear facilities and accelerators have become widely available, including cobalt-60, strontium-90, caesium-137 and iridium-192.

The present inventor notes that uranium 235 should be mentioned.

Millions of radioactive sources have been distributed worldwide over the past 50 years, with hundreds of thousands currently being used, stored, and produced. Worldwide, the IAEA has reported on specific applications: more than 10,000 radiotherapy units for medical care are in use; about 12,000 industrial sources for radiography are supplied annually; and about 300 irradiator facilities containing radioactive sources for industrial applications are in operation.

If spent nuclear fuel is to be reprocessed, the fuel elements and fuel rods are chopped into pieces, the pieces are chemically dissolved, and the resulting solution is separated into uranium, plutonium, high level waste (HLW), and various other process wastes.

According to Dr. Frank Settle, "Nuclear Chemistry Recycling Spent Reactor Fuel', published online by Chemcases.com at http://www.chemcases.com/nuclear/nc-13.html Three options are available for cooled spent fuel rods; they can remain at the sites from which they have been removed from service, be moved to a more permanent site for storage or they can be reprocessed to remove the uranium and plutonium. In either case, these fuel rods must cool in storage ponds near the reactor for several months in order to reduce their short-lived radioactivity and to allow them to dissipate their initial high thermal energy. Reprocessing involves chopping up the fuel rods and dissolving the pieces. The plutonium and uranium are then removed and chemically separated. The byproducts of reprocessing, transuranic elements and fission products can be encapsulated in glass and disposed as waste.

The online encyclopedia Widipedia mentions the following nuclear waste techniques: Vitrification, Ion Exchange, Synroc.

Vitrification: Long-term storage of radioactive waste requires the stabilization of the waste into a form which will neither react nor degrade for extended periods of time. One way to do this is through vitrification. M. I. Ojovan, W. E. Lee. An Introduction to Nuclear Waste Immobilisation, Elsevier, Amsterdam, 315 pp. (2005).

Currently at Sellafield (a nuclear processing site close to the village of Seascale on the cost of the Irish Sea in Cumbria, England), the high-level waste (PUREX (plutonium uranium extraction based on liquid-liquid extraction ion-exchange) first cycle raffinate (a liquid stream that remains after the extraction with the immiscible liquid to remove soutes from the original liquor)) is mixed with sugar and then calcined. Calcination involves passing the waste through a heated, rotating tube. The purposes of calcination are to evaporate the water from the waste, and de-nitrate the fission products to assist the stability of the glass produced. National Research Council (1996). Nuclear Wastes: Technologies for Separation and Transmutation. Washington D.C.: National Academy Press.

The 'calcine' generated is fed continuously into an induction heated furnace with fragmented glass. "Laboratory-scale vitrification and leaching of high-level waste for the purpose of simulant and glass and glass property models validation." Retrieved 2009 Jul. 7.

The resulting glass is a new substance in which the waste products are bonded into the glass matrix when it solidifies. This product, as a melt, is poured into stainless steel cylindrical containers ("cylinders") in a batch process. When cooled, the fluid solidifies ("vitrifies") into the glass. Such glass, after being formed, is highly resistant to water. Ojovanm M. I. et al. (2006). "Corrosion of nuclear waste glasses in non-saturated conditions: Time-Temperature behaviour" (PDF). Retrieved 2008 Jun. 30.

After filling a cylinder, a seal is welded onto the cylinder. The cylinder is then washed. After being inspected for external contamination, the steel cylinder is stored, usually in an underground repository. In this form, the waste products are expected to be immobilized for a long period of time (many thousands of years). OECD Nuclear Energy Agency (1994). The Economics of the Nuclear Fuel Cycle. Paris: OECD Nuclear Energy Agency.

The glass inside a cylinder is usually a black glossy substance. All this work (in the United Kingdom) is done using hot cell systems (shielded nuclear radiation containment chambers). The sugar is added to control the ruthenium chemistry and to stop the formation of the volatile $RuO_4$ containing radio ruthenium. In the west, the glass is normally a borosilicate glass (similar to Pyrex), while in the former Soviet bloc it is normal to use a phosphate glass. The amount of fission products in the glass must be limited because some (palladium, the other Pt group metals, and tellurium) tend to form metallic phases which separate from the glass. Bulk vitrification uses electrodes to melt soil and wastes, which are then buried underground. "Waste Form Release Calculations for the 2005 Integrated Disposal Facility Performance Assessment" (PDF). PNNL-15198. Pacific Northwest National Laboratory. July 2005. Retrieved 2006 Nov. 8. In Germany a vitrification plant is in use; this is treating the waste from a small demonstration reprocessing plant which has since been closed down. National Research Council (1996). Nuclear Wastes: Technologies for Separation and Transmutation. Washington D.C.: National Academy Press; Hensing, I., and W. Schultz (1995). Economic Comparison of Nuclear Fuel Cycle Options. Cologne: Energiewirtschaftlichen Instituts.

Ion Exchange: It is common for medium active wastes in the nuclear industry to be treated with ion exchange or other means to concentrate the radioactivity into a small volume. The much less radioactive bulk (after treatment) is often then discharged. For instance, it is possible to use a ferric hydroxide floc to remove radioactive metals from aqueous mixtures. http://www.euronuclear.org/info/encyclopedia/w/waste-processing.htm.

After the radioisotopes are absorbed onto the ferric hydroxide, the resulting sludge can be placed in a metal drum before being mixed with cement to form a solid waste form. Wilmarth, Mill, Dukes, "Removal of Silicon from High Level Waste Streams via Ferric Flocculation", Westinghouse Savannah River Company In order to get better long-term performance (mechanical stability) from such forms, they may be made from a mixture of fly ash, or blast furnace slag, and Portland cement, instead of normal concrete (made with Portland cement, gravel and sand).

Synroc: The Australian Synroc (synthetic rock) is a more sophisticated way to immobilize such waste, and this process may eventually come into commercial use for civil wastes (it is currently being developed for US military wastes). Synroc was invented by the late Prof Ted Ringwood (a geochemist) at the Australian National University. World Nuclear Association, Synroc, Nuclear Issues Briefing Paper 21. Retrieved January 2009.

The Synroc contains pyrochlore and cryptomelane type minerals. The original form of Synroc (Synroc C) was designed for the liquid high level waste (PUREX raffinate) from a light water reactor. The main minerals in this Synroc are hollandite ($BaAl_2Ti_6O_{16}$), zirconolite ($CaZrTi_2O_7$) and perovskite ($CaTiO_3$). The zirconolite and perovskite are hosts for the actinides. The strontium and barium will be fixed in the perovskite. The caesium will be fixed in the hollandite.

According to US patent application publication no. 2002/0122525:

[A]spent nuclear fuel storage pool . . . is designed to hold racks for storage of both fresh and spent nuclear fuel and other reactor components. When the nuclear reactor is refueled, the fresh fuel replaces a portion of the spent fuel in the reactor core and the spent fuel from the core is stored in the spent fuel storage pool. During refueling, the spent fuel pool is in fluid communication with the reactor vessel, and both the pool and the core as well as the area above the core are kept flooded with water. The water serves two functions. It acts as a radiation shield between the highly radioactive spent fuel and those who are refueling the core and as a coolant to absorb the heat of the radioactively decaying isotopes in the spent fuel. During routine operation of the power plant, this water will pick up contaminants, crud, and particulates.

According to U.S. Pat. No. 5,728,879:

Nuclear fuel assemblies for powering nuclear reactors generally consist of large numbers of fuel rods contained in discrete fuel rod assemblies. These assemblies or cells generally consist of a bottom end fitting or nozzle, a plurality of fuel rods extending upwardly therefrom and spaced from each other in a square or triangular pitch configuration, spacer grids situated periodically along the length of the assembly for support and orientation of the fuel rods, often a plurality of control guide tubes interspersed throughout the rod assembly, and a top end fitting or cap. Moreover, the assembly is installed and removed from the reactor as a unit.

When the nuclear fuel rods have expended a large amount of their available energy, the fuel rods are considered to be "spent," and the fuel rod assembly is pulled from the reactor and temporarily stored in an adjacent pool until the assemblies are transported to a reprocessing center or to permanent or temporary storage. Even though the rods are considered "spent," they are still highly radioactive and constitute a very real hazard both to personnel and to property.

In general, there are a number of alternatives available for disposition of the radioactive spent fuel rods, none of which is totally satisfactory. The fuel rod assemblies can be enclosed in a suitable basket and cask arrangement and transported to a storage facility, or possibly, to a reprocessing plant. A second alternative is to store the spent fuel in a dry storage system. Dry storage entails either the use of a large number of metal casks or the building of massive concrete containers either above or below ground, which is a very expensive process, and, where the storage system is above ground, it is often not acceptable to people living or working in its vicinity. A third alternative is the storage of the fuel units in the existing water pool originally designed for temporary storage. This type of storage is the simplest and cheapest, since the fuel rod assemblies can remain in the pool and be left there until the appropriate governmental agency or other agency collects them, often at the end of the life of the nuclear plant. However, such storage pools have a limited capacity, and, where they are adjacent to the nuclear reactor, necessitate the construction of a new pool when one becomes full.

Numerous attempts have been made to increase the capacity of a pool through a process known as fuel rod compaction or consolidation. This process, in brief, comprises removing the fuel rods from each fuel rod assembly and placing them in a storage canister where they are placed in rows with minimal spacing. It is possible, with this process, to place the fuel rods from two or more fuel assemblies into a single storage canister, thereby achieving approximately a 2:1 reduction in required pool volume, or, conversely, a 2:1 increase in pool storage capacity. However, successful consolidation has been an elusive goal for a number of reasons. Inasmuch as the pools are approximately forty feet deep, and inasmuch as the rods must remain immersed in the water at all times, all of the consolidation operations must be performed under the shield and cooling water. In addition, even though the rods are kept under water, the process could be quite hazardous to personnel performing the operation.

Prior art arrangements for achieving rod consolidation have included a system whereby the rods are pulled out row-by-row, as in, for example, a 14.times.14 matrix of rods, lifted and deposited in a tapered interim storage container, which tapers from a large area top opening to a bottom that has the area of a storage canister. After the intermediate container has the rods from approximately two fuel assemblies deposited therein, the intermediate container is placed over a storage canister, the bottom plate of the tapered container is lowered to cause the rods to slide into the storage canister. If the rods jam or stick, as they often do, they must be pushed from above the pool by operators using long rods. This last operation is made more difficult in that the rods develop on their outside surfaces what is referred to in the trade as "crud". When the fuel rods are pulled, this radioactive crud is scraped off and clouds the water making it difficult for the operators to see what they are doing and contaminating the pool. The method just described has proven to be quite slow and complicated, and can be hazardous to personnel.

Another problem associated with nuclear fuel rod consolidation is the disposal of spacer grids situated in the nuclear fuel rod assemblies for supporting the fuel rods and for maintaining the spacing between the fuel rods. The spacer grids are generally rigid metallic material, and there are usually about seven spacer grids in each rod assembly, or as few as three in gas cooled reactor fuel elements. Conventionally, during the process of fuel rod consolidation, the spacer grids have been crushed by a compactor in the pool, and the crushed remains are then placed in a storage canister. Oftentimes, the compactor has a first ram for crushing the spacer grid in a first direction and a second ram for crushing the spacer grid in a second direction which is orthogonal to the first. As a result, the spacer grids are compacted into a rectangular block which are discarded somewhere in the storage canisters.

However, crushing the spacer grids has been problematic in the art. During the crushing process, the rigid spacer grids break up and/or shatter, resulting in jamming of the compactor rams and creating a contamination problem in the surrounding pool area. Furthermore, the compactor ram surfaces which come in direct contact with the spacer grids during crushing operation become radioactively contaminated and must be disposed of in the storage canisters. Hence, the disposal and consolidation problem is further compounded.

Radiation shielding is known. For instance, the Global Spec website provides the following excerpt at http://www.globalspec.com/LearnMore/Materials_Chemicals_Adhesives/Electrical_Optical_Specialty_Materials/Radiation_Shielding: Radiation shielding is used to block or attenuate the intensity of alpha particles (helium atoms), beta particles (electrons), X-ray radiation, and gamma radiation (energetic electromagnetic radiation). It reduces the intensity of incident radiation by introducing a radiation-absorbing medium. The material and thickness of the radiation shield determine its effectiveness. Specifications for radiation shielding include material (e.g., lead, tungsten), thickness, purity of material (99.94% lead, etc.), and rated energy range of radiation blocked or attenuated (100 to 300 keV). Features (such as liquid-cooling) and applications are also important to consider. Many radiation protection products are listed or approved by organizations such Underwriters Laboratories (UL) or Underwriters Laboratories Canada (ULC). There are many types of radiation shielding. Most products are made of lead, a bluish-white, high-density, heavy metal that can effectively attenuate alpha rays, gamma rays, and X-rays. Lead shielding is a type of radiation shielding that includes lead aprons, lead barriers, lead-lined blankets, lead bricks, lead curtains, lead-lined cabinets, lead-lined doors, and rolled lead sheet. Lead aprons are protective garments worn by medical personnel and patients during X-ray procedures. Lead barriers and lead blankets are used to cover patients or medical equipment. Lead bricks are used for both positron emission tomography (PET) shielding and linear accelerator shielding. These radiation shielding products are also used in gamma knife rooms and in high dynamic range (HDR) imaging. Lead is also used in radiation shielding products such as lead curtains, lead-lined cabinets, lead-lined doors, and rolled lead sheet. Lead curtains are lined with vinyl and designed for use in medical facilities where secondary or low-level radiation is present. Lead-lined curtains may come equipped with a track and trolleys. Lead-lined cabinets and other lead-lined laboratory furniture are designed to store radioactive material and other radioactive inventory. Lead-lined doors are faced with wood, but have a thick layer of lead sheeting in the center. Rolled lead sheet is formed by moving a slab of refined lead between the rollers of a rolling mill. After the sheet is cut to size, the rolled lead is packed and shipped to suppliers of radiation shielding for use in various products.

Although it used in many types of radiation shielding, lead is ineffective against the high-energy electrons present in beta radiation and neutron radiation. Consequently, high-energy shielding is required in some medical and laboratory applications. For example, high-energy shielded decay drums are used to store high-energy radiopharmaceuticals. Nuclear medicine supplies and accessories also include X-ray shielding glass, a mirror-polished and scratch-resistant barium-type lead glass that is used in airports and other facilities that perform radiation screening.

The present inventor notes that beta radiation is from protons, not electrons. Lead serves as shielding material as lead is a stable, heavy metal of the periodic table with many electron orbits. There is room in the lead atom for the electrons to receive radiation energy and shift between the orbits in response to this energy, which ends up dissipated.

Therefore, it would be desirable to neutralize the radioactivity in hazardous waste by lessening its concentration and shielding it sufficiently so that it no longer remains potentially hazardous to those who might become exposed.

SUMMARY OF THE INVENTION

One aspect of the present invention relates to an amalgam of crushed hazardous radioactive waste and a copious amount of lead pellets to form a mixture. The mixture is compressed under pressure to compact it and roll it between sheets of shielding material that block radiation penetration. The end product has its radioactivity in effect neutralized and is thus safe for integration in to the environment for long-term storage purposes.

The hazardous radioactive waste may include spent fuel rods and other byproducts from nuclear reactors. Such waste is then chopped and crushed and preferably ground into tiny pieces. A copious amount of finely milled lead pellets are mixed with the tiny pieces (at a ratio of about 10 to 1) to form a mixture. The mixture is then compressed under pressure between sheets of lead slabs to become an amalgam, i.e., combining or uniting multiple constituents into one form. The lead sheets further block radiation penetration so as to neutralize radiation within the amalgam and the lead pellets likewise block or at least slows down radiation penetration. If necessary, the sheets may be heated to render them more malleable for tight winding into a spiral, cylindrical bale form. The bales may be compounded or compacted under pressure to change their shape from cylindrical into cubes. The cubes also effectively block the penetration of radiation—essentially becoming Geiger counter neutral. The cubes may be stored in abandoned uranium mines or in entombment chambers of basalt rock stones.

BRIEF DESCRIPTION OF THE DRAWING

For a better understanding of the present invention, reference is made to the following description and accompanying drawings, while the scope of the invention is set forth in the appended claims.

DESCRIPTION OF THE PREFERRED EMBODIMENT

Figure 1:
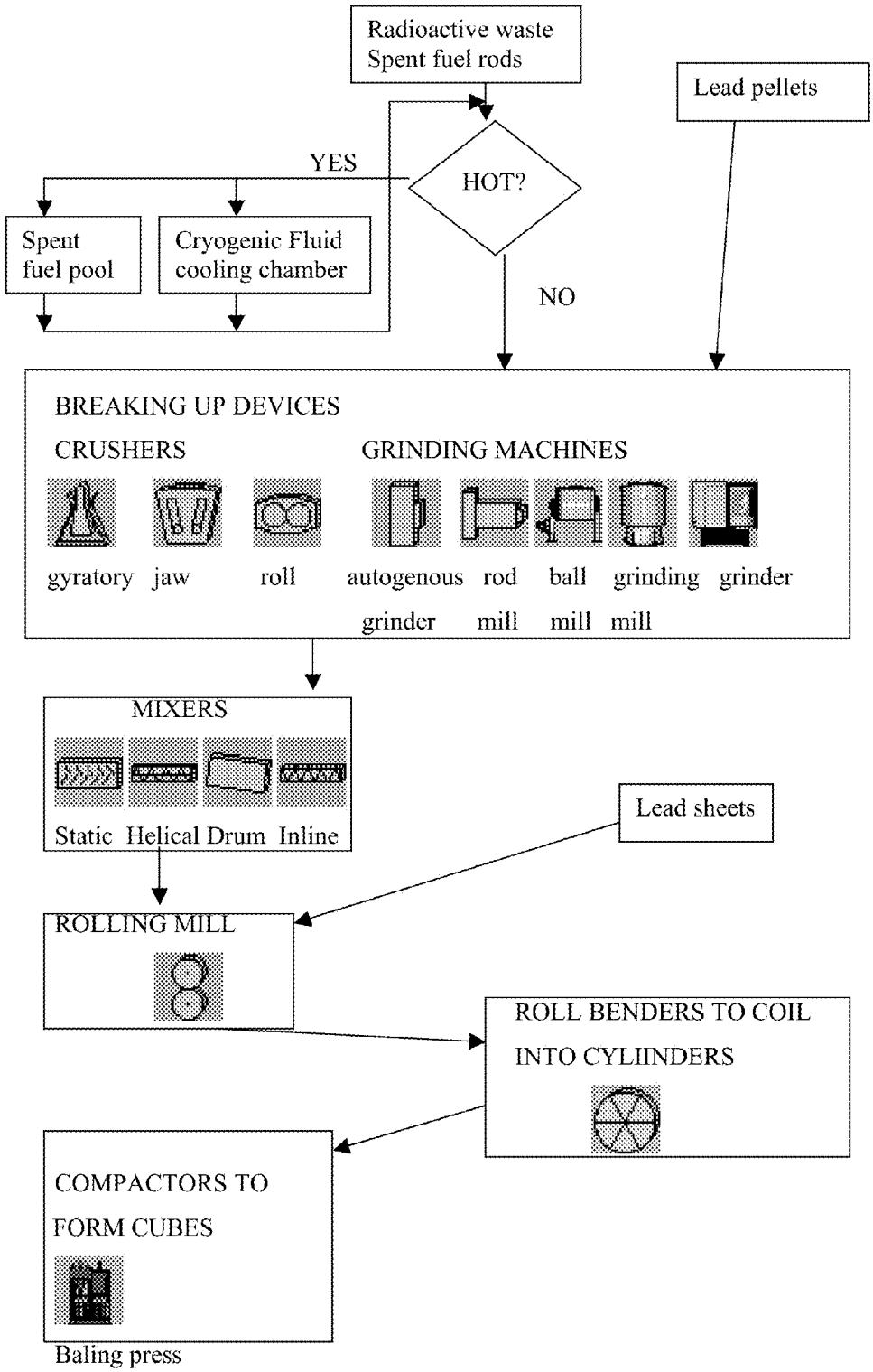
FIG. 1 is a flow diagram of processing nuclear waste in a manner for long term storage in accordance with the invention.

Turning to the figures, FIG. 1 is a flow diagram for processing spent nuclear fuel rods and other solid form nuclear waste in accordance with the invention via a series of processing steps that are carried out by appropriate processing equipment to form a radiation neutralized end product whose radioactivity content is effectively neutralized. Such an end product is an amalgam, which is defined as a combination of diverse elements or mixture. One may consider an amalgam to arise from an amalgamation in the sense of combining into an integral whole. The amalgam in accordance with the invention may be a mixture of crushed radioactive waste and a copious amount of lead pellets all spread into crevices of one or two lead sheets, which in turn sandwich the mixture under a compressive force.

Figure 2:
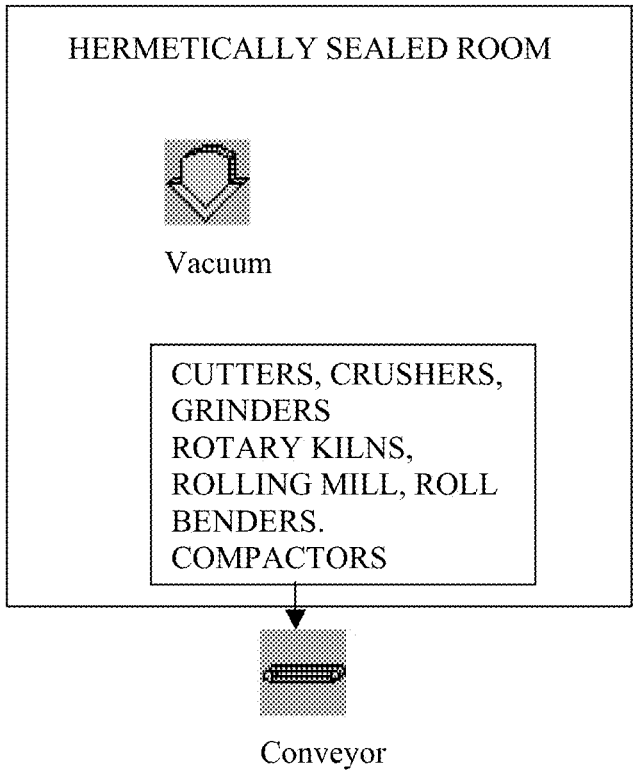
FIG. 2 is a schematic representation of a hermetically sealed room containing the equipment for processing nuclear waste of FIG. 1 together with a vacuum to capture fumes given off during processing and a conveyor to automate movement of materials into and out of the hermetically sealed room.

The processing equipment is preferably located in a hermetically sealed room as depicted in FIG. 2. The goal is to minimize exposure of workers operating the processing equipment and transporting the radioactive materials to be processed and stored. Thus, the equipment should be arranged to automatically deposit processed radioactive materials from one piece of equipment to another without the need for human intervention.

In the event of mishaps in processing, some human intervention may be required so appropriate safety measures need to be in place to shield the workers from radiation exposure. Thus, the workers should wear lead aprons and dressed in protective gear typically worn by workers working in nuclear facilities to shield themselves from radiation exposure.

Further, the hermetically sealed room should have its walls plated with lead or thick concrete or ducrete to minimize the risk of exposure. Finally, shielded arm extensions may be provided that allow workers to put their arms into them from outside the room that are either equipped with gloves that allow them to reach the equipment and materials if need be in a protected manner. Alternatively, mechanical arms may be provided that may be manipulated from outside the hermetically sealed room. The point is to minimize the need for workers to enter the hermetically sealed room.

As concerns the equipment itself, it should preferably be capable of being disassembled remotely so that when the equipment needs to be replaced, the equipment may be readily broken down as well for disposal as hazardous waste due to its long-term exposure to radioactive materials.

Turning again to FIG. 1, the processing steps may include:

- breaking up by chopping, grinding and/or crushing spent fuel rods or other radioactive metallic items into smaller, crushed pieces (perhaps into granular form) with a grinder or crusher, preferably no more than at most four spent fuel rods at a time,
- mixing the smaller, crushed pieces with finely milled lead pellets at a ratio of 1:10 or more with a mixer to form a mixture,
- encasing with encasing equipment the (softened) mixture between rolled lead sheets having a thickness resistant to penetration of radiation to form an encased product,
- compressing and milling the sandwiched encasement between rollers,
- winding the milled, sandwiched encasement into coiled cylindrical bales (that are radiation penetration resistant—essentially Geiger counter neutral,
- compounding the coiled bales into cubes with a mechanical press,
- carting and storing the cubes in old uranium mines or underground entombment chambers.

The entombment chambers may be made of blocks of basalt rock interdigitally connected as it is the least porous and thus help prevent leach out into underground waters.

If the spent fuel rods are still hot, then they may be allowed to cool in a conventional spent fuel cooling bath until they are cool before chopping, grinding and/or crushing them into the smaller pieces. On the other hand, the inventor surmises that even hot fuel rods, if cooled in a rapid manner with any cryogenic fluid such as liquid nitrogen, can remain cool long enough to be chopped, ground or crushed before there is a risk of the spent fuel rods heating from their internal radiation. Once the spent fuel rods are mechanically transformed essentially into granular form, their radioactivity will be less concentrated than before simply by dispersing the granular form over a larger area, i.e, such as by spreading the granular form in a mixture with lead pellets onto a sheet of radiation penetration resistance shield material.

U.S. Pat. No. 3,696,636, whose contents are incorporated herein by reference, exemplifies a suitable cyrogenic cooling chamber, albeit for cooling a fluid and thus requires some modification. Its spiral tubing for conveying the liquid to be cooled is dispensed with entirely. It is situated radially outside from where the cyrogenic coil is located that can contain liquid nitrogen. After removal of the spiral tubing for conveying the liquid to be cooling, what remains is either an empty void. If there is an empty void left, then the mouth of the chamber is widened to allow spent fuel rods to be dropped into the empty void (preferably one at a time, but at most four at one time to prevent too high a concentration of radioactivity from spent fuel rods). Once the spent fuel rods reach the bottom of the chamber, a trap door is opened to allow them to fall into a break up device (see FIG. 1).

If desired, a spiral chute may be provided into the empty void and thus replace the spiral tubing removed. The spent fuel rods are deposited at the top of the spiral chute, again at one at a time or at most four at one time to slide one after the other. The spiral chute would need to be formed to prevent spent fuel rods that slide from lodging into the chute in some way so as to become stuck. If becoming stuck is a potential problem, then the chamber would need to be equipped with tools necessary to free the spent fuel rods from the chute, such as a movable nozzle for blowing nitrogen gas at the spent fuel rods to urge the spent fuel rod to reposition itself to either fall off the chute or slide down it. Once the spent fuel rods reach the bottom of the chamber, a trap door is opened to allow them to fall into a mechanical transforming device (see FIG. 1).

Alternatively, the spent fuel rods could be fed into a cryogenic or liquid nitrogen cooling chamber of double cylinders with an inner tubing of steel. In the space between the inner tubing and the outer tubing of the double cylinders may be sand and liquid nitrogen coils. The spent fuel rods slide down through the central opening of the double cylinder a few at a time until they reach a trap door that leads to diverter that either directs the spent fuel rods to a chute for the chopping or grinding machine or to an elevator that raises the spent fuel rod up to be inserted again into the cooling chamber for repeated cooling.

Thermal, infrared and/or radiation sensors may be provided to detect the temperature and radioactivity of the spent fuels rods after passing through the cooling chamber to determine whether the spent fuel rods have reached a safe cooled temperature and radioactivity count to be ground in the time it takes to complete grinding before they become hot due to their radioactivity.

The mixture includes granular radioactive waste and lead pellets preferably at a ratio of at least 1:10. If radioactive liquids (such as radioactive water) need to be processed, then wheat flour may be added to the radioactive liquid to form a dense dough and added to the mixture. The dense dough binds molecules of radioactive liquid and is relatively cheap. Instead of wheat flour, cement powder may be used to form the dense dough. The mixture, together with the dense dough, may be ground. Further, used air filters from the vacuum system (that capture radioactive particles in the hermetically sealed room from the processing equipment) may be shredded and added to the mixture as well and replaced with fresh filters.

Figure 3:
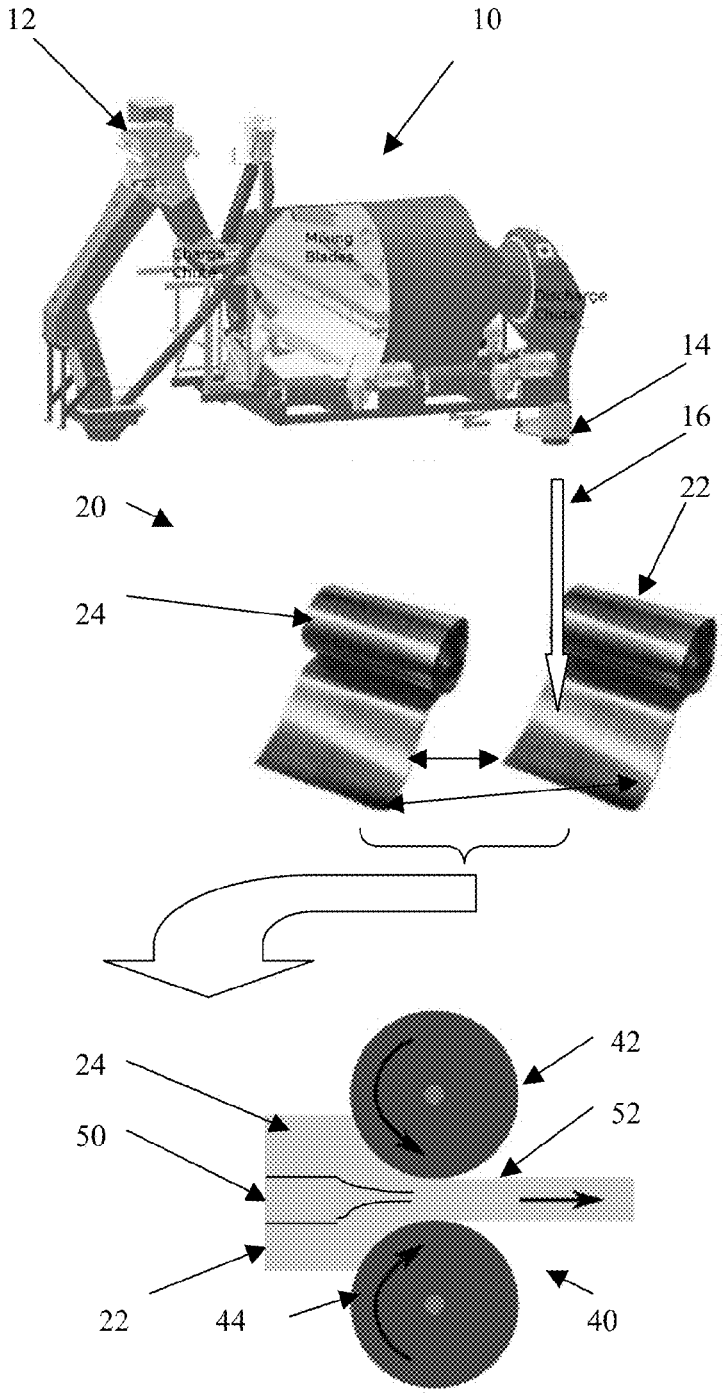
FIG. 3 is an isometric view of a roll of lead sheet that is conventional.

Turning to FIG. 3, the chopped, ground and crushed radioactive waste and the lead pellets are loaded into a charge chute 12 of a reversing drum mixer 10. The entire drum rotates around its axis as the materials are loaded through the charge chute 12 at one end of the drum and exit through a discharge chute 14 at the opposite end of the drum. Mixing blades are mounted on the inside surface of the drum and as the drum rotates the blades mix by lifting and dropping the materials during each rotation.

The mixture exits the discharge chute 14 to reach a roll mill 20. Here, the mixture is deposited in the direction of the arrow 16 onto an unraveling lead sheet 22, but is spread across the width of the lead sheet 22, either by a spreading implement or by moving the discharge chute 14 back and forth along the width of the lead sheet 22. Another lead sheet 24 is unraveled over the deposited mixture and placed onto the deposited mixture downstream to sandwich the mixture between lead sheets 22 and 24. Such may be accomplished, for instance, by angling the lead sheets 22, 24 along 45 degree inclines and parallel to each other and positioning the discharge chute 14 so that the deposit of the mixture occurs in the space between the cylindrical portions of the lead sheets 22, 24. Preferably, the faces of the lead sheets 22, 24 that face each other are mechanically stamped in advance to form crevices into which the mixture is dispersed. The pattern of crevices may be reminiscent of the nooks and crannies commonly found in a bread food product, i.e., English muffins. The crevice pattern should remain clear of the edges of the lead sheets by about a foot on all sides.

The sandwiched sheets 22, 24 contain the mixture and the lead pellets and fed to a roll mill 40 that has at least two rollers 42, 44 as shown that press the sandwiched sheets 22, 24 and the mixture 50 between them to squeeze the composite in a compressive manner. The resulting compressed structure 52 is essentially a unitary piece held together under pressure. Since about a foot on all sides between the lead sheet was clear of the crevice pattern, the lead sheets 22, 24 should seal to each other in that one foot smooth space from their edges. The squeezing of the sandwiched sheets 22, 24 may be repeated or otherwise conducted to ensure the filling of the crevices by the mixture and that the unified structure in effect becomes an amalgam.

If the compressive force imposed by the rollers is such that the lead sheets crack due to their brittleness, then either a lead alloy should be used to comprise the sheets instead of just lead that is sufficiently strong to avoid cracking under the compressive force of the rollers. Otherwise, two thin steel sheets may be employed. One is superimposed between the "top" rollers and the "top" lead sheet and the other is superimposed between the "bottom" rollers" and the "bottom lead sheet to take the brunt of the compressive force imposed by the rollers. The thin steel has a strength and maleability to withstand the compressive force without cracking and yet hold everything together.

Thereafter, the compressed sheets may be rolled into a spiral cylinder by a roll bender and then compacted into a cube by a baling press. The cubes are conveyed out of the hermetically sealed room that contains all the processing equipment and transported to a permanent storage facility or used uranium mines. There the cubes are placed into igloo-like entombment chambers made of tightly fitting rectangles of large basalt rock stores. The basalt rock prevents lead from leeching into ground soil thanks to its low porosity.

Figure 4:
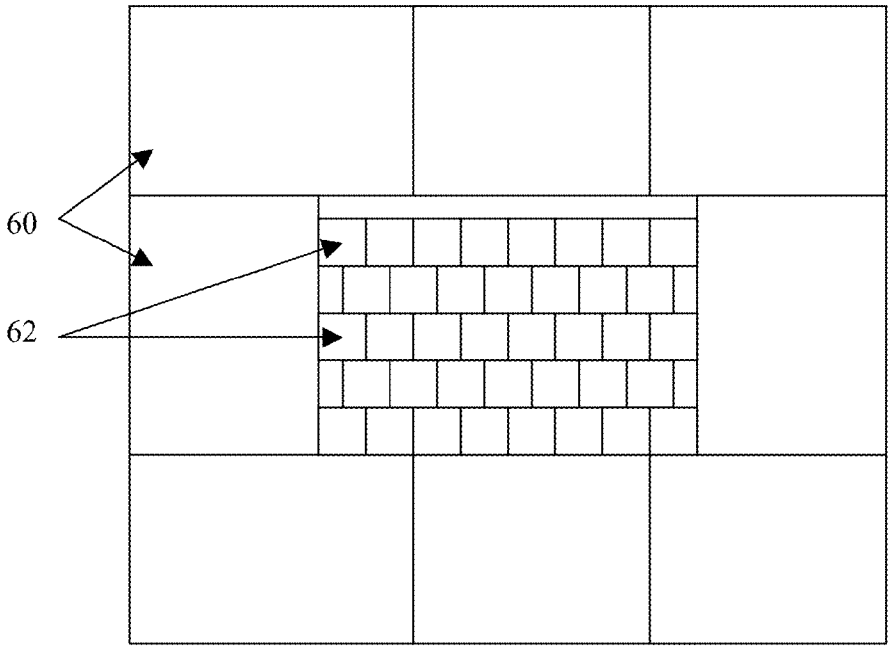
FIG. 4 is a schematic representation of an entombment chamber of basalt rock stones containing cubes of sandwiched lead sheet mixtures of lead pellets and granular radioactive waste.

FIG. 4 shows an entombment chamber for long-term storage of the cubes in accordance with the invention. The entombment chamber is lined by the tightly fitting rectangles of large basalt rock stores 60. Within the chamber is placed the cubes 62 before the chamber is completely sealed.

The amalgam (sandwiched mixture) in accordance with the invention is highly compacted under great pressure and cubed for storage and expected to contain internally al the radiation so there is essentially no appreciable radiation detected emanating from the cube (or at least not to a level that can create a health risk to humans from prolonged exposure).

The following is a list of conventional processing equipment that may be utilized in accordance with the invention for carrying out the processing steps of FIG. 1.

Choppers

Any conventional cutting tool or cutter used to chop spent nuclear fuel rods is suitable. According to Wikipedia:

A cutting tool (or cutter) is any tool that is used to remove material from the workpiece by means of shear deformation. Cutting may be accomplished by single-point or multipoint tools. Single-point tools are used in turning, shaping, planing and similar operations, and remove material by means of one cutting edge. Milling and drilling tools are often multipoint tools. Grinding tools are also multipoint tools. Each grain of abrasive functions as a microscopic single-point cutting edge (although of high negative rake angle), and shears a tiny chip.

Cutting tools must be made of a material harder than the material which is to be cut, and the tool must be able to withstand the heat generated in the metal-cutting process. Also, the tool must have a specific geometry, with clearance angles designed so that the cutting edge can contact the workpiece without the rest of the tool dragging on the workpiece surface. The angle of the cutting face is also important, as is the flute width, number of flutes or teeth, and margin size. In order to have a long working life, all of the above must be optimized, plus the speeds and feeds at which the tool is run.

Linear cutting tools include tool bits (single-point cutting tools) and broaches. Rotary cutting tools include drill bits, countersinks and counterbores, taps and dies, milling cutters, and reamers. Other cutting tools, such as bandsaw blades and fly cutters, combine aspects of linear and rotary motion.

Cutting tools are often designed with inserts or replaceable tips (tipped tools). In these, the cutting edge consists of a separate piece of material, either brazed, welded or clamped on to the tool body. Common materials for tips include tungsten carbide, polycrystalline diamond, and cubic boron nitride. Tools using inserts include milling cutters (endmills, fly cutters), tool bits, and saw blades.

Crushers

Some examples of conventional crushers and grinders are mentioned in the online encyclopedia Wikipedia. The conventional crushers and grinders include different types, such as a jaw crusher, a gyratory crusher, a cone crusher, and impact crushers (horizontal shaft impactor and vertical shaft impactor). The following are excerpts from Wikipedia regarding crushers, including a discussion of each of the different types of crushers:

In industry, crushers are machines which use a metal surface to break or compress materials. Mining operations use crushers, commonly classified by the degree to which they fragment the starting material, with primary and secondary crushers handling coarse materials, and tertiary and quaternary crushers reducing ore particles to finer gradations. Each crusher is designed to work with a certain maximum size of raw material, and often delivers its output to a screening machine which sorts and directs the product for further processing. Typically, crushing stages are followed by milling stages if the materials need to be further reduced. Crushers are used to reduce particle size enough so that the material can be processed into finer particles in a grinder. A typical circuit at a mine might consist of a crusher followed by a SAG mill followed by a ball mill. In this context, the SAG mill and ball mill are considered grinders rather than crushers.

A jaw or toggle crusher consists of a set of vertical jaws, one jaw being fixed and the other being moved back and forth relative to it by a cam or pitman mechanism. The jaws are farther apart at the top than at the bottom, forming a tapered chute so that the material is crushed progressively smaller and smaller as it travels downward until it is small enough to escape from the bottom opening. The movement of the jaw can be quite small, since complete crushing is not performed in one stroke. The inertia required to crush the material is provided by a weighted flywheel that moves a shaft creating an eccentric motion that causes the closing of the gap. Single and double toggle jaw crushers are constructed of heavy duty fabricated plate frames with reinforcing ribs throughout. The crushers components are of high strength design to accept high power draw. Manganese steel is used for both fixed and movable jaw faces. Heavy flywheels allow crushing peaks on tough materials. Double Toggle jaw crushers may feature hydraulic toggle adjusting mechanisms.

A gyratory crusher is similar in basic concept to a jaw crusher, consisting of a concave surface and a conical head; both surfaces are typically lined with manganese steel surfaces. The inner cone has a slight circular movement, but does not rotate; the movement is generated by an eccentric arrangement. As with the jaw crusher, material travels downward between the two surfaces being progressively crushed until it is small enough to fall out through the gap between the two surfaces.

A gyratory crusher is one of the main types of primary crushers in a mine or ore processing plant. Gyratory crushers are designated in size either by the gape and mantle diameter or by the size of the receiving opening. Gyratory crushers can be used for primary or secondary crushing. The crushing action is caused by the closing of the gap between the mantle line (movable) mounted on the central vertical spindle and the concave liners (fixed) mounted on the main frame of the crusher. The gap is opened and closed by an eccentric on the bottom of the spindle that causes the central vertical spindle to gyrate. The vertical spindle is free to rotate around its own axis. The crusher illustrated is a short-shaft suspended spindle type, meaning that the main shaft is suspended at the top and that the eccentric is mounted above the gear. The short-shaft design has superseded the long-shaft design in which the eccentric is mounted below the gear.

A cone crusher is similar in operation to a gyratory crusher, with less steepness in the crushing chamber and more of a parallel zone between crushing zones. A cone crusher breaks rock by squeezing the rock between an eccentrically gyrating spindle, which is covered by a wear resistant mantle, and the enclosing concave hopper, covered by a manganese concave or a bowl liner. As rock enters the top of the cone crusher, it becomes wedged and squeezed between the mantle and the bowl liner or concave. Large pieces of ore are broken once, and then fall to a lower position (because they are now smaller) where they are broken again. This process continues until the pieces are small enough to fall through the narrow opening at the bottom of the crusher.

A cone crusher is suitable for crushing a variety of mid-hard and above mid-hard ores and rocks. It has the advantage of reliable construction, high productivity, easy adjustment and lower operational costs. The spring release system of a cone crusher acts an overload protection that allows tramp to pass through the crushing chamber without damage to the crusher.

Impact crushers involve the use of impact rather than pressure to crush material. The material is contained within a cage, with openings on the bottom, end, or side of the desired size to allow pulverized material to escape. This type of crusher is usually used with soft and non-abrasive material such as coal, seeds, limestone, gypsum or soft metallic ores. There are two types of impact crushers: horizontal shaft impactor and vertical shaft impactor. The horizontal shaft impactor (HIS) crushers break rock by impacting the rock with hammers that fixed upon the outer edge of a spinning rotor. The practical use of HSI crushers is limited to soft materials and non abrasive materials, such as limestone, phosphate, gypsum, weathered shales.

Vertical shaft impactor (VSI) crushers use a different approach involving a high speed rotor with wear resistant tips and a crushing chamber designed to 'throw' the rock against. The VSI crushers utilize velocity rather than surface force as the predominant force to break rock. In its natural state, rock has a jagged and uneven surface. Applying surface force (pressure) results in unpredictable and typically non-cubicle resulting particles. Utilizing velocity rather than surface force allows the breaking force to be applied evenly both across the surface of the rock as well as through the mass of the rock. Rock, regardless of size, has natural fissures (faults) throughout its structure. As rock is 'thrown' by a VSI Rotor against a solid anvil, it fractures and breaks along these fissures. Final particle size can be controlled by 1) the velocity at which the rock is thrown against the anvil and 2) the distance between the end of the rotor and the impact point on the anvil. The product resulting from VSI Crushing is generally of a consistent cubicle shape such as that required by modern SUPERPAVE highway asphalt applications. Using this method also allows materials with much higher abrasiveness to be crushed than is capable with an HSI and most other crushing methods.

VSI crushers generally utilize a high speed spinning rotor at the center of the crushing chamber and an outer impact surface of either abrasive resistant metal anvils or crushed rock. Utilizing cast metal surfaces 'anvils' is traditionally referred to as a "Shoe and Anvil VSI". Utilizing crushed rock on the outer walls of the crusher for new rock to be crushed against is traditionally referred to as "rock on rock VSI". VSI crushers can be used in static plant set-up or in mobile tracked equipment.

Grinders

Some examples of conventional grinders (grinding machines) include a ball mill, a rod mill, a SAG mill, an autogenous mill, pebble mill, high pressure grinding mill and vertical shaft impactor (VSI) mill. The following are excerpts from the online encyclopedia Wikipedia:

In materials processing a grinder is a machine for producing fine particle size reduction through attrition and compressive forces at the grain size level.

Ball Mill

A typical type of fine grinder is the ball mill. A slightly inclined or horizontal rotating cylinder is partially filled with balls, usually stone or metal, which grinds material to the necessary fineness by friction and impact with the tumbling balls. Ball mills are characterized by their smaller (comparatively) diameter and longer length. The feed is at one end of the cylinder and the discharge is at the other. Ball mills are commonly used in the manufacture of Portland cement.

Rod Mill

A rotating drum causes friction and attrition between steel rods and ore particles.

SAG Mill

SAG is an acronym for Semi-Autogenous Grinding, and applies to mills that utilize steel balls in addition to large rocks for grinding. A Sag mill is generally used as a primary or first stage grinding solution. The SAG mills use a minimal ball charge of 6 to 15%. SAG mills can be as large as 42' in diameter, using as much as 28 MW in power. A rotating drum throws large rocks and steel balls in a cataracting motion which causes impact breakage of larger rocks and compressive grinding of finer particles. Attrition in the charge causes grinding of finer particles. SAG mills are characterized by their large diameter and short length. The inside of the mill is lined with lifting plates to lift the material inside up and around the inside of the mill, where it then falls off the plates and falls back down. SAG mills are primarily used in the gold, copper and platinum industries with applications also in the lead, zinc, silver, alumina and nickel industries.

Autogenous Mill

A rotating drum throws large rocks in a cataracting motion, which causes impact breakage of larger rocks and compressive grinding of finer particles. It is similar in operation to a SAG mill, but does not use steel balls in the mill. Attrition in the charge causes grinding of finer particles.

Pebble Mill

A rotating drum causes friction and attrition between rock pebbles and ore particles.

High Pressure Grinding Mills

The ore is fed between two rollers, which are pushed firmly together while their rotating motion pushes the ore through a small gap between them. Extreme pressure causes the rocks to fracture into finer particles and also causes microfracturing at the grain size level. It consists of a pair of horizontal cylindrical rollers through which material is passed. The two rollers rotate in opposite directions, "nipping" and crushing material between them. A similar type of intermediate crusher is the edge runner, which consists of a circular pan with two or more heavy wheels known as mullers rotating within it; material to be crushed is shoved underneath the wheels using attached plow blades.

Vertical Shaft Impactor Mill

A type of fine grinder which uses a free impact of rock or ore particles with a wear plate. High speed of the motion of particles is achieved with a rotating accelerator. This type of mill uses the same principle as the VSI Crusher.

Mixers

According to the online encyclopedia Wikipedia:

The most common mixers used today fall into 3 categories: Twin-shaft mixers, Vertical axis mixers (Pan and Planetary mixers) and Drum mixers (Reversing Drum and Tilting Drum).

Twin-shaft mixers are known for their high intensity mixing, and short mixing times. These mixers are typically used for high strength concrete, RCC and SCC, typically in batches of 2-6 $m^3$. Vertical axis mixers are most commonly used for precast and prestressed concrete. This style of mixer cleans well between batches, and is favoured for coloured concrete, smaller batches (typically 0.75-3 $m^3$), and multiple discharge points. Within this category, the Pan mixers are losing popularity to the more efficient Planetary (or counter-current) mixers as the additional mixing action helps in production of more critical concrete mixes (colour consistency, SCC, etc.). Drum mixer (reversing drum mixer and tilting drum mixers) are used where large volumes of concrete are being produced (batch sizes of 3-9 $m^3$). This type of mixer dominates the ready-mixed market as it is known to be capable of high production speeds, ideal for slump concrete, and where overall cost of production is important. Drum mixers are known to have the lowest maintenance and operating cost of the three styles of mixers.

A reversing drum mixer entire drum rotates around its axis as materials are loaded through a charge chute at one end of the drum and exit through a discharge chute at the opposite end of the drum. Mixing blades are mounted on the inside surface of the drum and as the drum rotates the blades mix by lifting and dropping the materials during each rotation. "Concrete Mixing Methods and Concrete Mixers: State of the Art", Chiara F. Ferraris, Journal of Research of the National Institute of Standards and Technology, March-April 2001.

Once the materials are sufficiently mixed the rotation of the drum is reversed and the blade arrangement pushes the concrete through to the discharge end of the mixer. Reversing drum mixers provide for efficient mixing and leave very little build up within the mixer. "Classification of Mixers", Penn State College of Engineering, retrieved 2009-11-13.

Wear is reduced as the drum rests on rubber or polyurethane wheels and there is no steel on steel contact. There is no direct contact between the stationary charge and discharge chutes and the rotating drum. The flexible tires, absorb vibration and make for low maintenance and a quiet operation.

Rolling Mill

The use of a rolling mill to form rolls of lead sheets is known. For instance, Global Spec has a website that provides the following excerpt at http://www.globalspec.com/Learn-More/Materials_Chemicals_Adhesives/Electrical_Optical_Specialty_Materials/Radiation_Shielding:

Rolled lead sheet is formed by moving a slab of refined lead between the rollers of a rolling mill. After the sheet is cut to size, the rolled lead is packed and shipped to suppliers of radiation shielding for use in various products. Although it used in many types of radiation shielding, lead is ineffective against the high-energy electrons present in beta radiation and neutron radiation. Consequently, high-energy shielding is required in some medical and laboratory applications. For example, high-energy shielded decay drums are used to store high-energy radiopharmaceuticals. Nuclear medicine supplies and accessories also include X-ray shielding glass, a mirror-polished and scratch-resistant barium-type lead glass that is used in airports and other facilities that perform radiation screening.

Another company, Gravita India Limited, commercializes rolled lead sheets and discusses in their website at www.gravitaindia.com/leadproducts/html the advantages of lead for radiation shielding:

By virtue of its resistance to chemical corrosion, Lead sheet also finds use for the lining of chemical treatment baths, acid Plant and storage vessels. The high density of Lead sheet and its "limpness" makes it a very effective material for reducing the transmission of noise through partitions and doors of comparatively lightweight construction. Often the Lead sheet is adhesively bonded to plywood or to other building boards for convenience of handling. A particular advantage of Lead's high density is that only relatively thin layers are needed to suppress the transmission of sound. This makes for important space savings in the design of large modern buildings such as hotels and office blocks.

Lead and its alloys in metallic form and Lead compounds are used in various forms of radiation shielding. Their high densities meet the primary requirement of a shielding material and in certain shielding applications Lead's high atomic number is also important. The ease with which Lead can be worked is of added value. The shielding of containers for radioactive materials is usually metallic Lead. Radioactive materials in laboratories and hospitals are usually handled by remote control from a position of safety behind a wall of Lead bricks and X ray machines are normally installed in rooms lined with sheet Lead. Lead compounds are a constituent of the glass used in shielding partitions to permit safe viewing and Lead powder is incorporated into plastic and rubber sheeting as a material for protective clothing.

Roll Benders

The online encyclopedia Wikipedia provides:

A roll bender is a mechanical jig having three rollers used to form a metal bar into a circular arc. The rollers freely rotate about three parallel axes, which are arranged with uniform horizontal spacing. The two outer rollers have the same fixed vertical height and make contact with the underside of the bar to be formed. The middle roller has an adjustable height and makes contact with the topside of the bar.

The bar to be shaped is assumed to have a uniform cross-section, but not necessarily rectangular, as long as there are no overhanging contours, i.e. positive draft. Such bars are often formed by extrusion. The bar is suspended between the rollers. The end rollers support the bottom-side of the bar and have a matching contour (inverse shape) to it. so to maintain the cross-sectional shape. Likewise, the middle roller is forced against the topside of the bar and has a matching contour to it.

After the bar is initially inserted into the jig, the middle roller is manually lowered and forced against the bar with a screw arrangement. This causes the bar to undergo both plastic and elastic deformation. The portion of the bar between the rollers will take on the shape of a cubic polynomial, which approximates a circular arc. The rollers are then rotated moving the bar along with them. For each new position, the portion of the bar between the rollers takes on the shape of a cubic modified by the end conditions imposed by the adjacent sections of the bar. When either end of the bar is reached, the force applied to the center roller is incrementally increased, the roller rotation is reversed and as the rolling process proceeds, the bar shape becomes a better approximation to a circular arc, gradually, for the number of passes required to bring the arc of the bar to the desired radius.

The plastic deformation of the bar is retained throughout the process. However, the elastic deformation is reversed as a section of bar leaves the area between the rollers. This "spring-back" needs to be compensated in adjusting the middle roller to achieve a desired radius. The amount of spring back depends upon the elastic compliance (inverse of stiffness of the material relative to its ductility.

Systems for forming sheet material into spiral rolls are known conventionally, such as from U.S. Pat. No. 4,102,512 whose contents are incorporated by reference.

Compounders

A conventional compounder is a metal baling press. Individual or multiple cylinders of the coiled lead sheet sandwiched mixtures may be reshaped into cubes in a metal baling press.

Conveyors

The finished cubes (or cylinders if not transformed into cubes) may be conveyed out of the hermetically sealed room by a conveyor.

As an alternative to applying the radioactive waste and lead pellet mixture between two lead sheets and squeezing between rollers, the mixture may be applied to a single lead sheet is then coiled upon itself. Once the coil is complete, compressive forces may be applied radially to the outermost coil inwardly, but it may be necessary to sandwich the coiled sides between two plates to prevent the coil from moving axially while the radial compressive force is applied. The coiled end product may then takes on the same kind of cylindrical bale shape as is achieved by sandwiching the radioactive waste and lead pellet mixture and compressing with rollers, except with a single lead sheet instead of two. The cylindrical bale shape may then be shaped under pressure into cubes.

While the foregoing description and drawings represent the preferred embodiments of the present invention, it will be understood that various changes and modifications may be made without departing from the scope of the present invention.

What is claimed is:

1. A method of shielding radioactive waste to neutralize radioactivity of the waste, comprising encasing a mixture of radioactive waste and lead pellets by at least one sheet of shielding material, the mixture having a greater volume of lead pellets than radioactive waste, compressing the encased mixture to form a product, the shielding material and lead pellets being radiation penetration resistant and of sufficient volume to render the product Geiger counter neutral as concerns detecting radiation emission from the product.

2. The method of claim 1, further comprising winding the product into a spiral form.

3. The method of claim 1, wherein the mixture contains at least 1 part of the granular radioactive waste to 10 parts of the lead pellets by volume.

4. The method of claim 1, further comprising the encasing includes spreading the mixture onto a face of the at least one sheet of shielding material before the step of compressing, the face having crevices into which lodges the spread mixture, the crevices being spaced from an entire perimeter of the face so as to provide a region clear of crevices that neighbors the entire perimeter.

5. The method of claim 1, further comprising granulating the radioactive waste entirely, mixing the granulated radioactive waste with the lead pellets to form the mixture.

6. The method of claim 1, wherein the shielding material is selected from a group consisting of lead and a material containing pyrochlore and cryptomelane minerals.

7. The method of claim 1, wherein the radioactive waste includes spent nuclear fuel rods.

8. The method of claim 1, further comprising breaking up the radioactive waste into smaller pieces, mixing the smaller pieces with the lead pellets to form the mixture, the breaking up being selected from a group consisting of chopping, grinding, crushing and any combination thereof.

9. The method of claim 1, further comprising rolling the compressed, encased mixture into one of a cylindrical shape and a cubic shape.

10. The method of claim 1, wherein the encasing takes place within a hermetically sealed room having equipment to carry out the encasing, the equipment being shielded with material that blocks radiation emission from the radioactive waste that is being encased by the equipment.

11. The method of claim 10, further comprising cyrogenically cooling the radioactive waste with liquid nitrogen as a cryogenic fluid before carrying out the breaking up.

12. The method of claim 1, further comprising entombing the product within a chamber of basalt rock.

13. The method of claim 1, wherein the encasing is carried out by sandwiching the mixture between two of the sheets of the shielding material, the two sheets having a respective face that faces each other, the two sheets having respective inner faces that face each other and having crevices into which is lodged the mixture, the crevices being spaced from an entire perimeter of the at least one face so as to bound a region clear of crevices that neighbors the entire perimeter.

14. The method of claim 1, wherein the encasing is carried out by sandwiching the mixture by at most a single sheet of the shielding material by winding the single sheet into a spiral, the single sheet having a face with crevices into which is lodged the mixture, the crevices being spaced from an entire perimeter of the face so as to bound a region clear of crevices that neighbors the entire perimeter.

15. The method of claim 1, further comprising, before the step of compressing, spreading the mixture onto a face of the at least one sheet of shielding material and sandwiching the mixture by winding the single sheet into a spiral.

16. The method of claim 1, further comprising, before the step of compressing, sandwiching the mixture between two of the sheets of the shielding material after spreading the mixture onto a face of the at least one sheet of shielding material, the two sheets each having a respective face that faces each other.

17. The method of claim 16, further comprising carrying out the compressing to compress the sandwich mixture between rollers.

18. The method of claim 1, further compressing the mixture between rollers.

19. A shielded, radioactive waste product having radioactivity of the waste neutralized, comprising an encased mixture of radioactive waste and lead pellets by at least one sheet of shielding material, the mixture having a greater volume of lead pellets than radioactive waste, the encased mixture being in a compressed state to constitute a product, the shielding material and lead pellets being radiation penetration resistant and of sufficient volume to render the product Geiger counter neutral as concerns detecting radiation emission from the product.

20. The shielded radioactive waste product of claim 19, wherein the mixture has in a proportion by volume of at least 1 part of radioactive waste to 10 parts of lead pellets.

21. The shielded radioactive waste product of claim 19, wherein the product has a shape selected from the group consisting of a cylinder and a cube.

22. The shielded radioactive waste product of claim 19, wherein the product is entombed within a chamber of basalt rock.

23. The shielded radioactive waste product of claim 19, wherein the radioactive waste is entirely in granular form.

24. The shielded radioactive waste product of claim 19, wherein the at least one sheet of shielding material has a face with crevices, the radioactive waste lodging in the crevices, the crevices being spaced from an entire perimeter of the at least one lead sheet so as to form a region neighboring the entire perimeter that is clear of the crevices.

25. The shielded radioactive waste product of claim 19, wherein the shielding material is selected from a group consisting of lead and a material containing pyrochlore and cryptomelane minerals.

26. The shielded radioactive waste product of claim 19, wherein the mixture is sandwiched between two sheets of the shielding material that have a face with crevices into which is lodged the mixture, the crevices being spaced from an entire perimeter of the face so as to bound a region neighboring the entire perimeter that is clear of the crevices.

27. An apparatus, comprising a chamber having radioactive contents; means for cryogenically cooling the radioactive contents of the chamber with cryogenic fluid; break-up means for breaking up the radioactive contents into minute pieces; and emptying means for emptying the chamber of the contents into the break-up means.

28. The apparatus of claim 27, wherein the break-up means is selected from a group consisting of a chopper, a grinder and a crusher and any combination thereof.

29. The apparatus of claim 27, wherein the chamber has a tube containing the cryogenic fluid.

30. The apparatus of claim 27, further comprising means for mixing lead pellets with the minute pieces of the radioactive contents to form a mixture such that a volume of the lead pellets is greater than a volume of the minute pieces.

31. The apparatus of claim 30, further comprising means for encasing the mixture by at least one sheet of shielding material, and means for compressing the encased mixture to form a product, the shielding material and lead pellets being radiation penetration resistant and of sufficient volume to render the product Geiger counter neutral as concerns detecting radiation emission from the product.

32. The apparatus of claim 30, wherein the means for compressing includes rollers between which the encased mixture compresses.

* * * * *